US007707726B2

(12) United States Patent
Shiba

(10) Patent No.: US 7,707,726 B2
(45) Date of Patent: May 4, 2010

(54) RECIPROCATING ELECTRIC SHAVER

(75) Inventor: Shinji Shiba, Matsumoto (JP)

(73) Assignee: Izumi Products Company, Nagano (JP)

( * ) Notice: Subject to any disclaimer, the term of this patent is extended or adjusted under 35 U.S.C. 154(b) by 269 days.

(21) Appl. No.: 11/891,545

(22) Filed: Aug. 10, 2007

(65) Prior Publication Data

US 2008/0209736 A1 Sep. 4, 2008

(30) Foreign Application Priority Data

Aug. 11, 2006 (JP) ..... 2006-220053

(51) Int. Cl.
*B26B 19/02* (2006.01)

(52) U.S. Cl. ..... 30/43.92; 30/43.1; 30/43.2; 30/346.51

(58) Field of Classification Search ..... 30/43.1, 30/43.2, 43.6, 43.9, 43.91, 43.92, 346.51
See application file for complete search history.

(56) References Cited

U.S. PATENT DOCUMENTS 6,073,348 A * 6/2000 Shiba ..... 30/34.1
6,293,017 B1 * 9/2001 Sato et al. ..... 30/43.92
6,568,083 B1 * 5/2003 Taniguchi et al. ..... 30/43.2
7,464,471 B2 * 12/2008 Fukutani et al. ..... 30/43.91

FOREIGN PATENT DOCUMENTS

| | | |
|---|---|---|
| EP | 0 951 970 | 10/1999 |
| EP | 1 676 680 | 7/2006 |
| JP | 2006-149445 | 6/2006 |

* cited by examiner

*Primary Examiner*—Boyer D. Ashley
*Assistant Examiner*—Laura M. Lee
(74) *Attorney, Agent, or Firm*—William L. Androlia; H. Henry Koda

(57) ABSTRACT

A reciprocating shaver including an inner cutter upwardly pushing spring for pressing the inner cutter against the inner surface of the outer cutter; slide members held on the outer cutter frame so as to be able to slide; outer cutter elastically supporting members which are for elastically supporting the outer cutter and mounted in the outer cutter frame with one end of each one of them engaging one of the slide members, and another end thereof engaging the outer cutter; and float setting members which are provided in the shaver main body and respectively engage the slide members, in linkage with the mounting motion of the outer cutter frame relative to the shaver main body, so as to determine the position of the slide members.

7 Claims, 6 Drawing Sheets

RECIPROCATING ELECTRIC SHAVER

BACKGROUND OF THE INVENTION

1. Field of the Invention

The present invention relates to a reciprocating electric shaver for shaving face whiskers ("hair") by causing an inner cutter to move reciprocally while being pressed against the inner surface of an outer cutter that is substantially inverted-U-shaped when viewed from the side.

2. Description of the Related Art

Reciprocating electric shavers are commonly known. Generally, reciprocating electric shavers are made so that an inner cutter is caused to move reciprocally while it is being pressed against the inner surface of an outer cutter that is substantially inverted-U-shaped when seen from the side, and hair coming through the slits provided in the outer cutter is cut by the reciprocating inner cutter.

In the reciprocating electric shaver disclosed in Japanese Patent Application No. 2004-340838 (Japanese Patent Application Laid-Open (Kokai) No. 2006-149445), an outer cutter is held so that it can slide freely up and down in an outer cutter frame secured to a shaver main body that contains a motor, and an inner cutter, which is urged upward by an inner cutter upwardly pushing spring, is caused to move reciprocally while being pressed against the inner surface of the outer cutter. More specifically, in this shaver, an oscillator is employed, and this oscillator is vibrated by the motor housed in the shaver main body; in addition, the inner cutter is provided on this oscillator so that it is capable of swinging and is urged upward by an inner cutter upwardly pushing spring. The inner cutter is moved reciprocally while being pressed against the inner surface of the outer cutter by a prescribed spring force.

In this conventional shaver, the contact pressure of the outer cutter against the skin (hereinafter called the outer cutter float pressure) is set by the upward pushing force of the inner cutter, that is, by the spring force of the inner cutter upwardly pushing spring. Accordingly, the outer cutter, when contact is made against the skin with a force stronger than the spring force of the inner cutter upwardly pushing spring, will sink in (or descend) while compressing the inner cutter upwardly pushing spring.

The ideal pressure (float pressure) when the outer cutter sinks in varies depending on the condition of the hair or skin of the user or on the preference of the user. In the above-described conventional shaver, it becomes necessary to change the spring force of the inner cutter upwardly pushing spring in order to change that float pressure. In order to weaken the outer cutter float pressure, for example, the inner cutter upwardly pushing spring may be made weaker. When that is done, however, the contact pressure between the inner cutter and the outer cutter will become weaker, and there will be a danger that the sharpness of the shave will deteriorate. In order to strengthen the outer cutter float pressure, conversely, the inner cutter upwardly pushing spring may be made stronger. When that is done, however, the contact pressure between the inner cutter and the outer cutter tends to become excessive, leading to such problems as the noise caused by sliding sounds becoming greater, or the temperature of the outer cutter surface rising due to the heat of friction.

In view of the above situations, the inventor of the present application studied a structure of elastically supporting the outer cutter in the up and down direction relative to the outer cutter frame, for the purpose of being able to set the float pressure while optimally maintaining the contact pressure between the outer cutter and the inner cutter. It was found preferable that the outer cutter float pressure be adjustable from the shaver main body side. When, however, in such an adjustable structure, an outer cutter frame and shaver main body linking mechanism, that is, a mechanism for transmitting the movement of a manipulator on the shaver main body side to the float pressure adjustment mechanism on the outer cutter frame side, becomes necessary, and the structure as a result becomes complex.

BRIEF SUMMARY OF THE INVENTION

Accordingly, an object of the present invention, devised in view of the above-described circumstances, is to provide a reciprocating electric shaver in which, when provision is made so that the outer cutter float pressure is suitably set from the shaver main body side while optimally maintaining the contact pressure between the outer cutter and the inner cutter, a linking mechanism for transmitting the movement of the manipulator on the shaver main body side to the float pressure adjustment mechanism on the outer cutter frame side is made simple, and a provision that the float pressure is automatically set in linkage with the attachment and detachment of the outer cutter, so that outer cutter attachability-detachability and cleaning efficiency are enhanced.

The above object is accomplished by a unique structure of the present invention for a reciprocating electric shaver that includes an outer cutter which is substantially inverted-U-shaped when viewed from the side and provided so as to slide up and down in an outer cutter frame that is detachably mounted on the main body of the shaver, and an inner cutter which is reciprocated while being pressed upward from below against an inner surface of the outer cutter; and in the present invention, the shaver further includes:

an inner cutter upwardly pushing spring for pressing said inner cutter against the inner surface of said outer cutter;

slide members slidably provided on the outer cutter frame;

outer cutter elastically supporting members for elastically supporting said outer cutter, the outer cutter elastically supporting members being mounted on said outer cutter frame with one end of each one of the outer cutter elastically supporting members being engaged with one of said slide members and another end thereof being engaged with said outer cutter; and float setting members provided in said shaver main body so that said float setting members are caused to engage said slide member, in linkage with a mounting motion of said outer cutter frame relative to said shaver main body, thus determining a position of said slide members.

seen from the above, in the present invention, the outer cutter elastically supporting members for elastically supporting the outer cutter is provided separately from the inner cutter upwardly pushing spring. Accordingly, the outer cutter float pressure can be varied by way of changing the spring force of the outer cutter elastically supporting members. If the spring force of the outer cutter elastically supporting members is oriented downward (toward the shaver main body), the outer cutter float pressure will be such that the difference (F(IN)−F(OUT)), which is between the spring force F(IN) of the inner cutter upwardly pushing spring and the spring force F(OUT) of the outer cutter elastically supporting members will be the outer cutter float pressure F(TOT), and the outer cutter float pressure F(TOT) will become smaller. Conversely, if the spring force of the outer cutter elastically supporting members is oriented upward, then the outer cutter float pressure F(TOT) will be the sum (F(IN)+F(OUT)) and will become larger.

Moreover, in the present invention, in the shaver main body, float setting members are provided, and, in linkage with the outer cutter frame mounting motion relative to the shaver main body, the float setting members engage the slide members, determine the position of the slide members, and set the elastic support force of the outer cutter elastically supporting members. Thus, the structure is simple, and the shaver has an enhanced outer cutter attachability-detachability. As a consequence, outer cutter cleaning can be done easily, and cleaning efficiency is high.

When the outer cutter elastically supporting members urge the outer cutters downward (toward the shaver main body), then the spring force F(OUT) is set smaller than the spring force F(IN) of the inner cutter upwardly pushing spring. In this setting, the outer cutter float pressure will be the difference shown by F(IN)−F(OUT) and will be weaker upward.

The outer cutter elastically supporting members may urge the outer cutter upward. In this structure, the outer cutter float pressure will become a spring force that is a total of the spring force F(IN) of the inner cutter upwardly pushing spring and the spring force F(OUT) of the outer cutter elastically supporting members. As a consequence, the outer cutter float pressure can be made very large.

The outer cutter elastically supporting members which push the outer cutter downward (toward the shaver main body) can be compression coil springs which are compressed and installed (or installed in a compressed manner) between the outer cutter and the outer cutter frame. Instead, pulling springs that pull the outer cutter down can be used in lieu of the compression coil spring. Further, the outer cutter elastically supporting member can be elastic bodies made of a synthetic resin. It is preferable that the outer cutter elastically supporting members be installed such that both ends of the outer cutter are supported with the same spring force. In that case, the spring force is a total value of the spring forces of the outer cutter elastically supporting members at the two (right and left) ends of the outer cutter.

In the present invention, an adjustment mechanism for adjusting the spring force of the outer cutter elastically supporting member can be obtained by, for example, such a structure that the slide member are provided so as to be movable up and down relative to the outer cutter frame, and compression coil that constitute the outer cutter elastically supporting members are provided so that the upper ends thereof are in contact with one of the slide members and the lower ends thereof are in contact with the outer cutter, thus urging the outer cutter downward (toward the shaver main body).

In the present invention, further, it is possible to set the height of the slide members by the float setting members provided in the shaver main body. This can be done by such a structure that slide member downward pushing spring, which are stronger than the compression coil springs that constitute the outer cutter elastically supporting members, are compressed and installed between each of the slide members and the outer cutter frame so that the slide members are being provided with a downward return force, and then each of the slide members is butted against the float setting members provided in the shaver main body, thus fixing the height thereof.

Furthermore, the height of the float setting members is made changeable by a manual manipulator provided in the shaver main body, and this makes it possible that the slide member height can be changed with such a manual manipulator. Thus, in the present invention, it is possible to easily adjust the outer cutter float pressure by changing the spring force of the outer cutter elastically supporting members. For the manual manipulator, one that is manipulated from the outside of the shaver main body has a better manipulability and is preferable. Nevertheless, the manipulator can be provided in an opening of the upper portion of the shaver main body that appears when the outer cutter is removed.

DETAILED DESCRIPTION OF THE INVENTION

Figure 1:
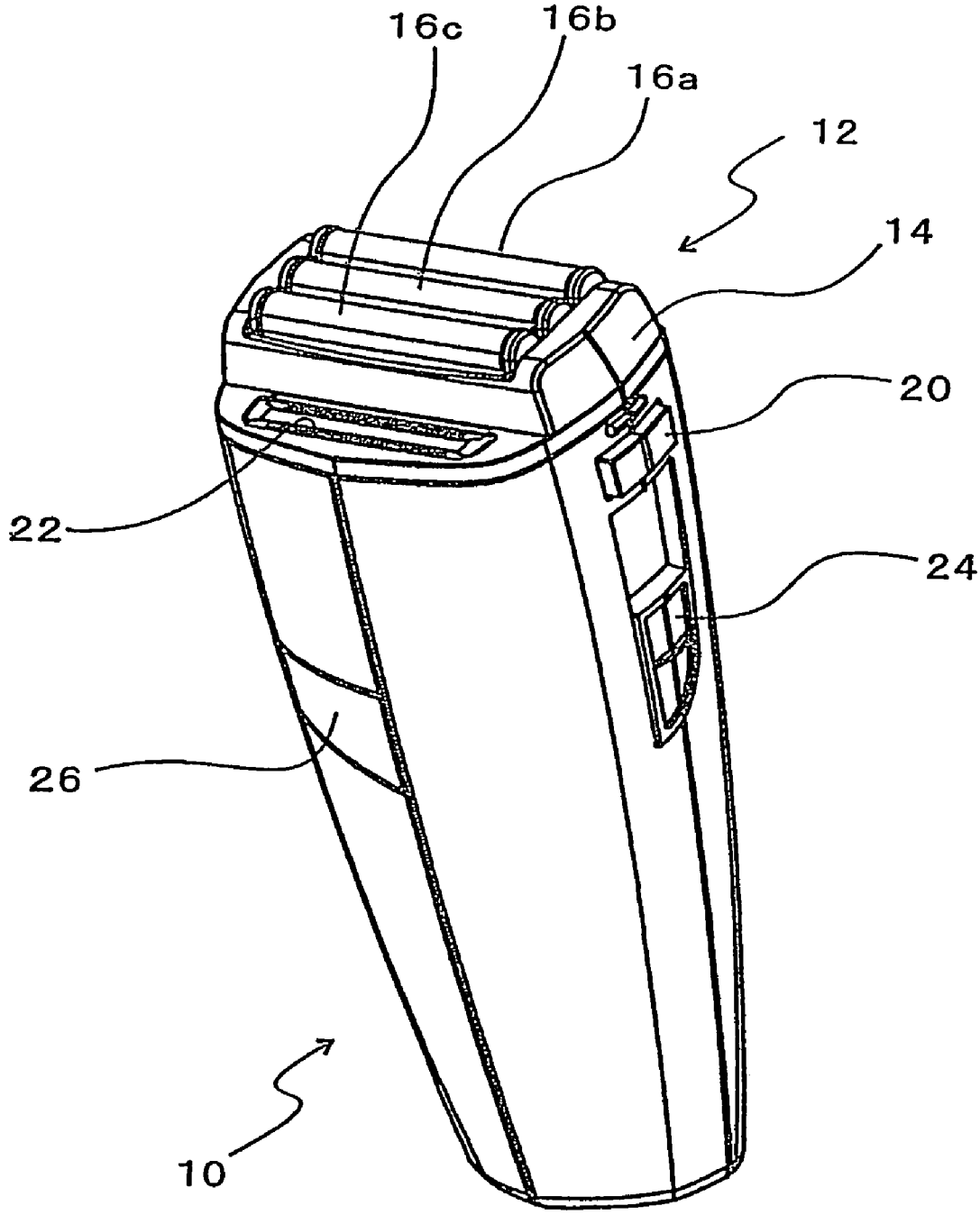
FIG. 1 is an external perspective view of a reciprocating shaver according to one embodiment of the present invention.
Figure 2:
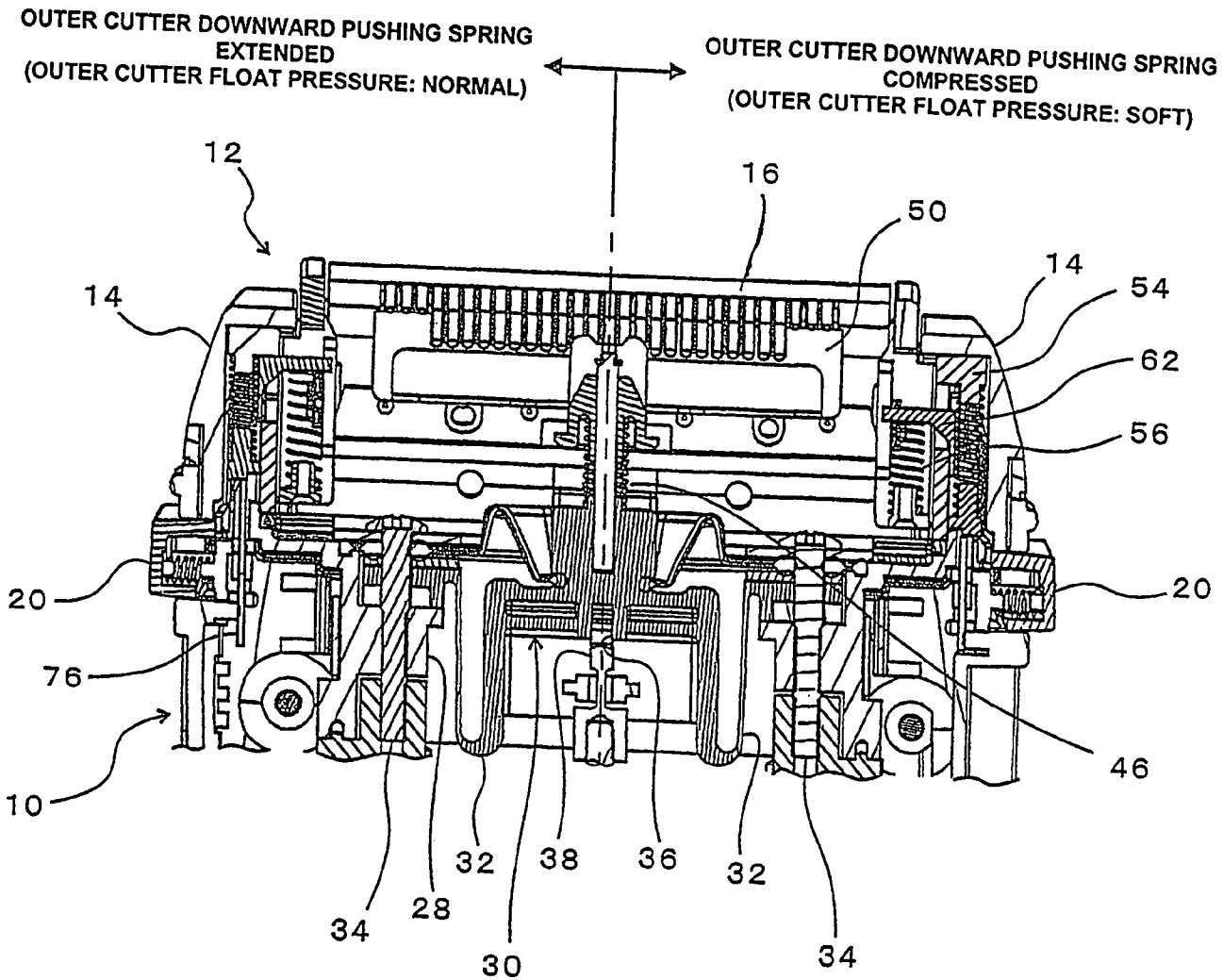
FIG. 2 is a vertical section of the shaver head unit thereof.
Figure 3A:
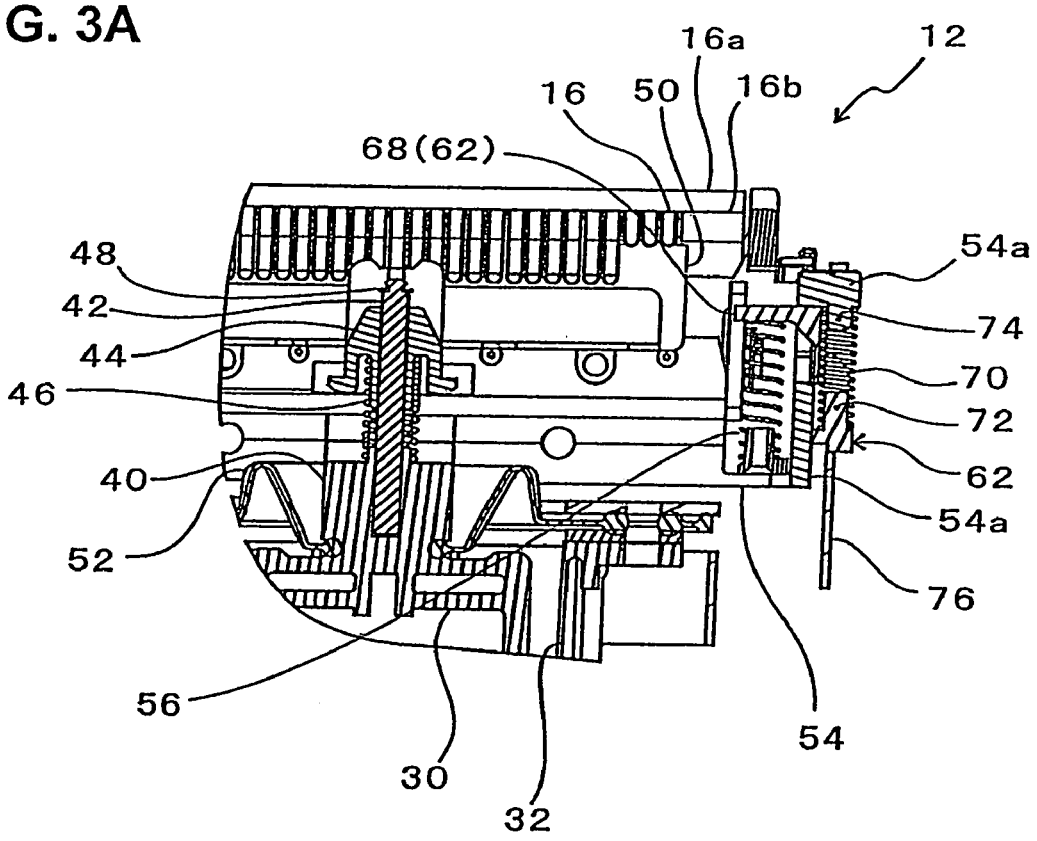
FIGS. 3A and 3B are enlarged views, in cross section, of a part of the shaver head unit of FIG. 2.
Figure 3B:
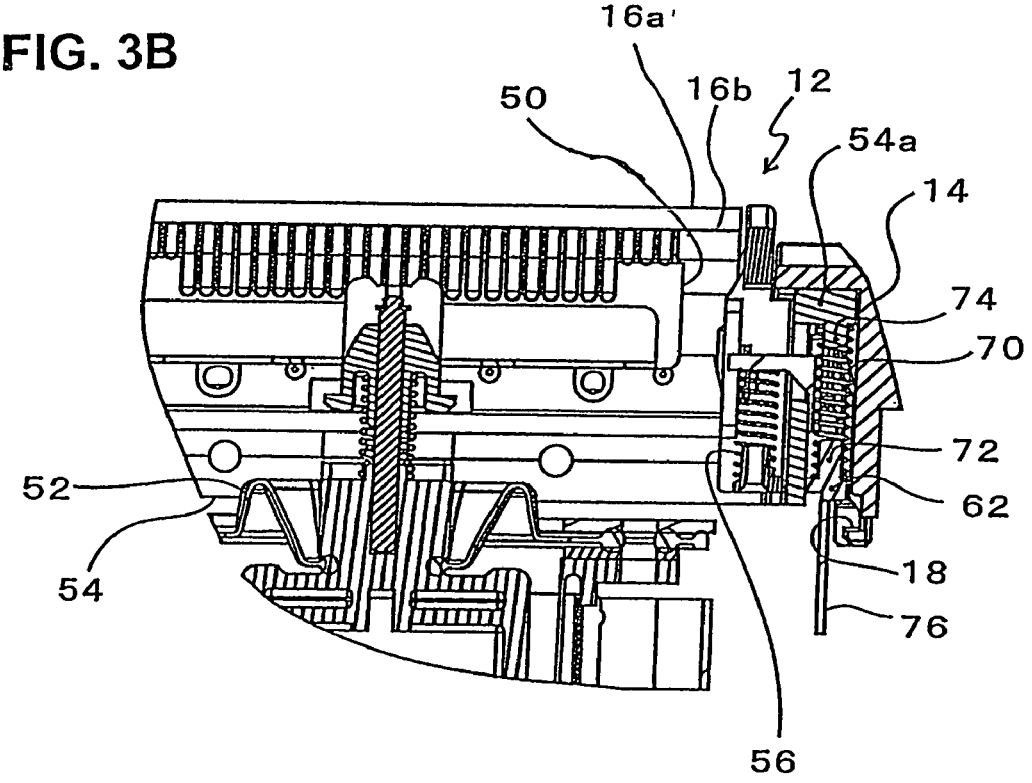
Figure 4:
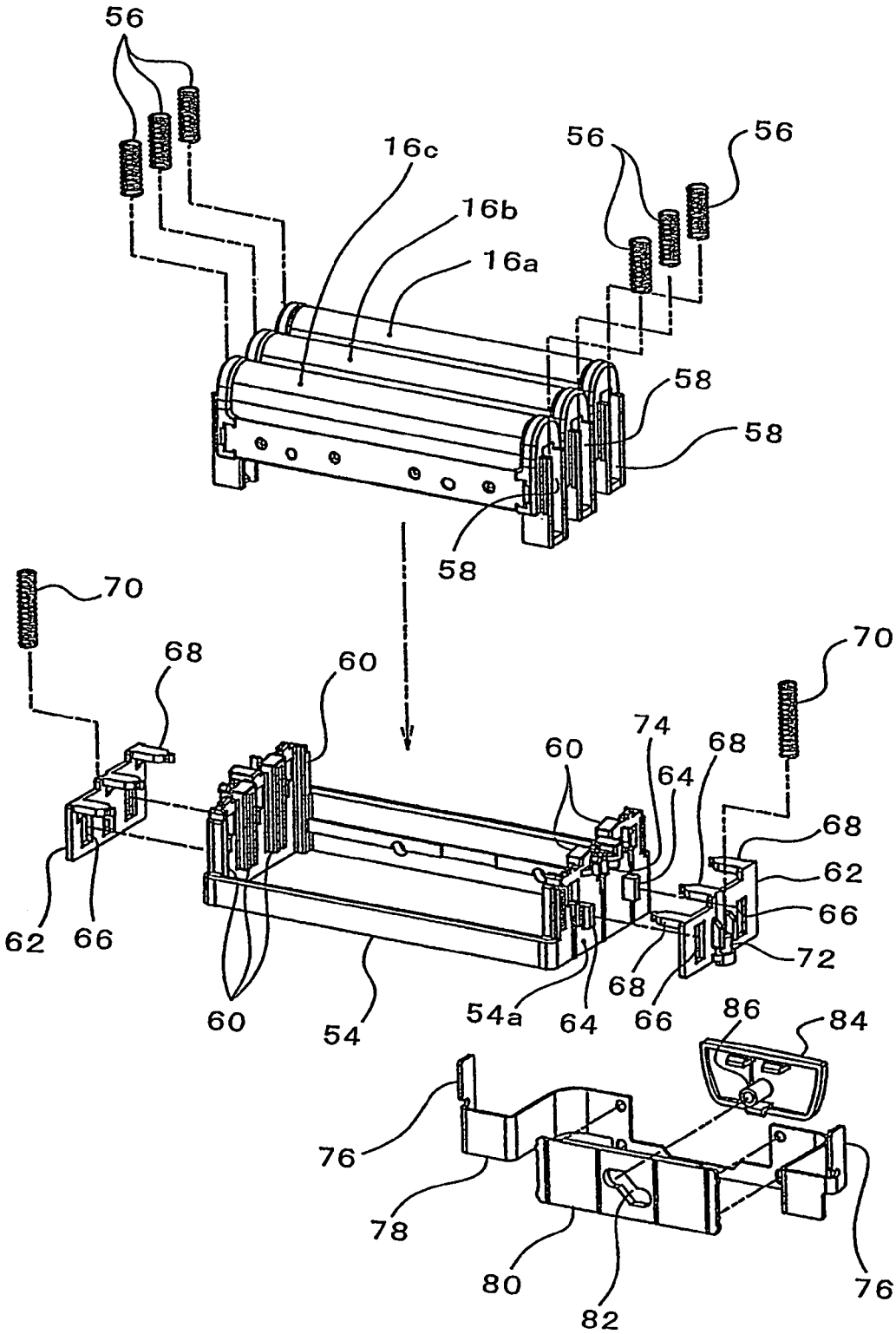
FIG. 4 is an exploded perspective view of the shaver head unit.
Figure 5:
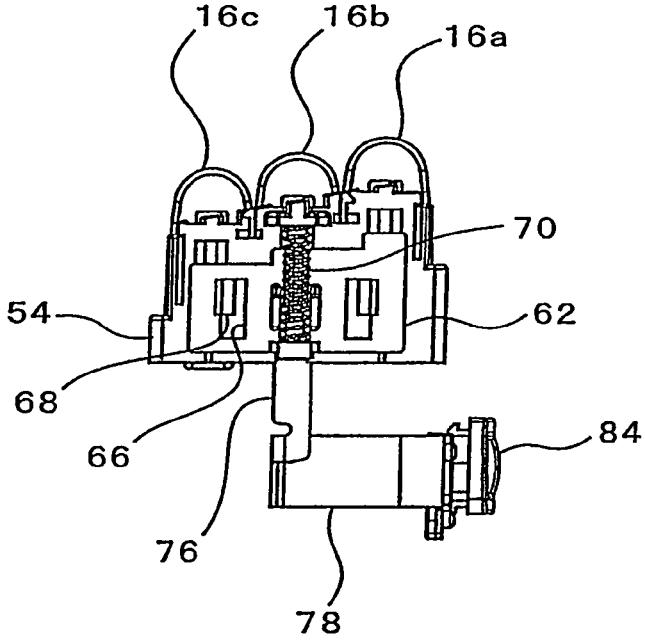
FIG. 5 is a side elevation of an adjustment mechanism for a float setting member.
Figure 6:
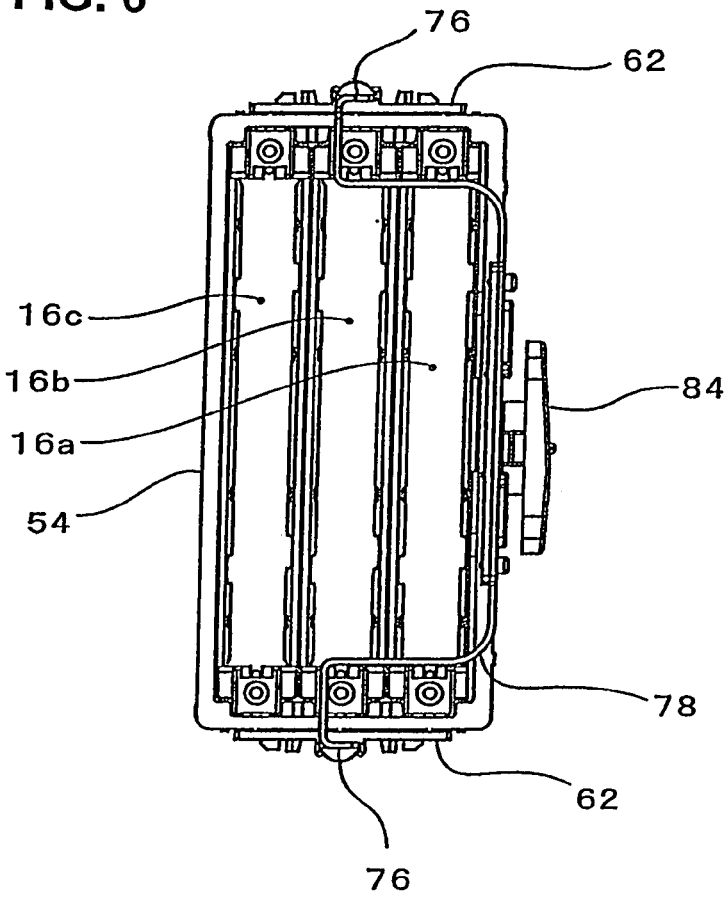
FIG. 6 is a bottom view of the same.
Figure 7:
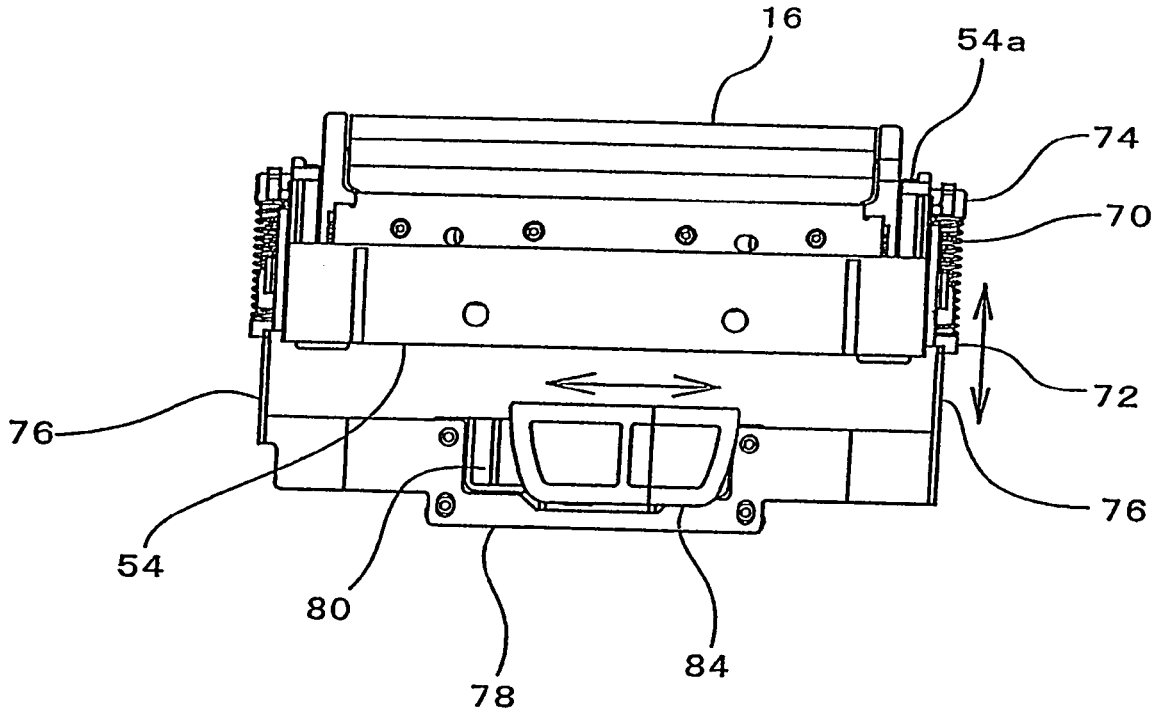
FIG. 7 is a rear view of the same.

FIG. 1 is a perspective view of the reciprocating shaver according to one embodiment of the present invention, while FIG. 2 is a vertical section of the shaver head unit of this shaver. In FIG. 2, a condition in which the outer cutter float pressure is made either strong or ordinary (normal) is illustrated on the left half of the drawing, and a condition in which the outer cutter float pressure is made weak (soft) is illustrated on the right half of the drawing. FIG. 3A, a partial view of FIG. 2, shows the situation in which the outer cutter float pressure is made strong (normal), and FIG. 3B, another partial view of FIG. 2, shows the situation in which the outer cutter float pressure is made weak (i.e. soft, corresponding to the right half of FIG. 2). FIG. 4 shows the shaver head unit disassembled, and FIG. 5 shows the detail of a mechanism for adjusting the height of a slide member by a manual manipulator. FIG. 6 is a bottom view of the slide member height adjusting mechanism and FIG. 7 is a rear view thereof.

In FIG. 1, the reference numeral 10 is a main body of the shaver of the present invention, and this shaver main body 10 houses therein a battery, an electric motor, a control circuitry and other required shaver components (not shown in FIG. 1). An outer cutter assembly 12 is detachably attached from above to the upper end of the shaver main body 10. The outer cutter assembly 12 includes three outer cutters 16*a*, 16*b* and 16*c* (shown by "16*a* to 16*c*" or merely by "16" in the description below) that are installed in parallel inside a head cover 14 (see FIG. 2) and so as to make up and down motions. In the head cover 14, four first engagement pawls 18 (see FIG. 3B) are provided to protrude downward, while shaver head attachment-detachment buttons ("shaver head buttons") 20 imparted with a tendency to return so as to protrude to the outside are mounted on the left and right side surfaces of the shaver main body 10. Second engagement pawls (not shown) formed in the shaver head buttons 20 are provided so as to be engaged with and disengaged from the first engagement pawls 18.

The head cover 14 covers the upper surface (upper end) of the shaver main body 10 except a part on its front side, so that that part of the upper portion of the shaver main body 10 on the front side is exposed. That exposed portion accommodates a fine shaving blade 22. More specifically, the fine shaving blade 22 is provided to protrude upward by a manipulator 24 provided in the shaver main body 10. When using the fine shaving blade 22, the manipulator 24 is pushed upward to make the fine shaving blade 22 protrude upward. In FIG. 1, the fine shaving blade 22 is retracted in the shaver main body 10. The reference numeral 26 in FIG. 1 is an electrical power switch. When the electrical power switch is pressed once, the motor in the shaver main body 10 starts running, and when it is pressed once more, the motor stops.

In FIG. 2, the reference numeral 28 is an inner block secured on the inside of the upper part of the shaver main body 10, while 30 is an oscillator mounted in an opening in the inside block 28. The left and right edges of the oscillator 30 are secured by screws 34, through U-shaped flexible connectors 32. In the lower center surface of the oscillator 30, an elongated channel 36 is formed, long in the direction perpendicular to the drawing surface of FIG. 2. Into this long channel 36, a vibrating shaft 38 which moves eccentrically by the rotational power of the motor is engaged. As a consequence, when the motor runs, the oscillator 30 vibrates to the left and right in FIG. 2.

An inner cutter holder 40 protrudes out at the center of the upper surface of the oscillator 30, and a vertical shaft 42 is secured to the inner cutter holder 40. In this vertical shaft 42, a slider 44 is provided so that it can freely slide up and down. A coil spring 46 is compressed and installed (or installed in a compressed manner) between the slider 44 and the inner cutter holder 40 of the oscillator 30, so that a tendency to return upward is imparted to the slider 44. The coil spring 46, as will be described in detail below, is a spring that will constitute an inner cutter upwardly pushing spring in the present invention. The slider 44, moreover, is prevented from sliding completely off the vertical shaft 42 by a stopper 48 provided at the upper end of the vertical shaft 42.

The reference numeral 50 refers to inner cutters that respectively slide against the inner surfaces of the three outer cutters 16. The inner cutters 50 are provided so that they can swing left and right by the slider 44 and are capable of being oscillated sideways (left and right) by the oscillator 30. Though three inner cutters 50, respectively corresponding to the three outer cutters 16*a* to 16*c*, are provided, only one is shown in FIGS. 2, 3A and 3B. Also, a sealing member 52 is installed between the upper surface of the inside block 28 and the inner cutter holder 40 of the oscillator 30 to prevent water from coming into the shaver main body 10.

Next, the outer cutter assembly 12 will be described.

The outer cutter assembly 12, as illustrated in FIG. 4, has three outer cutters 16*a*, 16*b* and 16*c* installed in an outer cutter frame 54 so that they can move up and down, and the outer circumference thereof is enclosed by the head cover 14 (FIGS. 1 and 2). The outer cutter frame 54, when the head cover 14 is secured to the shaver main body 10, is held and secured between the head cover 14 and the shaver main body 10.

At either end of the outer cutters 16*a* to 16*c*, spring loading chambers 58 are provided for respectively loading therein outer cutter downward pushing springs 56 which constitute outer cutter elastically supporting members in the present invention. These spring loading chambers 58 are guided by guides 60 projecting from the inner surfaces of two end plates 54*a* of the outer cutter frame 54, making it possible for the outer cutters 16*a* to 16*c* to move up and down. On the outer surface of each one of the two end plates 54*a* of the outer cutter frame 54, a slide member 62 is attached so that it can freely move up and down. More specifically, two engagement pawls 64 are formed to project from the each one of the outer surfaces of the end plates 54*a* of the outer cutter frame 54, and these engagement pawls 64 are brought to be engaged with long vertical slits 66 formed in the respective slide members 62.

On the upper edge of each one of the slide members 62, three horizontal projections 68 are formed (inwardly) that pass through the long vertical openings formed in each end plate 54*a* of the outer cutter frame 54 and advance horizontally into the spring loading chambers 58 for the outer cutters 16. These horizontal projections 68 engage with the upper ends of the outer cutter downward pushing springs 56 provided in the spring loading chambers 58 for the outer cutters 16. More specifically, the outer cutter downward pushing springs 56 are compressed in such a condition that the lower ends thereof are in contact with (or engaged with) the bottom surfaces of the spring loading chambers 58 while the upper ends thereof are in contact with (or engaged with) the horizontal projections 68 of the slide members 62.

A downward oriented return force is imparted to the slide members 62 by slide member downward pushing springs 70 which are compressed and installed between the outer cutter frame 54 and the slide members 62. More specifically, the lower end of each of the springs 70 is latched by a projection 72 formed at the center of the lower edge of each one of the slide members 62, while the upper end of the spring 70 is latched by a projection 74 formed at the center of the upper edge of each one of the end plates 54*a* of the outer cutter frame 54. These springs 70 exhibit a return force that is stronger than the combined spring forces of the downward pushing springs 56 for the three outer cutters. As a consequence, the slide members 62, while being subjected to an upward counterforce by the outer cutter downward pushing springs 56, are also subjected to a downward counterforce by these slide member downward pushing springs 70. Because the downward counterforce of the slide member downward pushing springs 70 is larger than the upward counterforce of the outer cutter downward pushing springs 56, the slide members 62 can stay at the descended positions.

More specifically, the slide members 62 stabilize at positions where the engagement pawls 64 of the end plates 54*a* of the outer cutter frame 54 are butted against the upper edges of the slits 66 of the slide members 62. This situation is shown in the left half of FIG. 2, in FIG. 3A, and in FIGS. 5 and 7. In this situation, the outer cutter downward pushing springs 56 are in the extended state; as a result, the force (F(OUT)) pushing the outer cutters 16*a* to 16*c* down is small. Accordingly, the difference from the upward pushing force (F(IN)) of the inner cutter upwardly pushing spring 46, the difference being F(TOT)=F(IN)−F(OUT), will become greater.

The height level of the slide members 62 is set by float setting members 76 provided in the shaver main body 10. As shown in FIGS. 4 and 6, the float setting members 76 are formed so that they rise upward from both ends of a horizontal plate 78 that is provided inside the back surface (wall) of the shaver main body 10 so as to be movable vertically or up and down. These float setting members 76 advance out and upward through vertical grooves formed in the shaver head buttons 20 so as to face the lower surfaces of the center of the lower edges of the slide members 62 (the lower surfaces of the projections 72). As a result, when the outer cutter assembly 12 is attached to the shaver main body 10 and locked to the shaver head buttons 20, the lower edges of the slide members 62 contact the upper edges of the float setting members 76, and the height of the float setting members 76 is thus fixed as shown in, for instance, FIGS. 3A and 3B A cam plate 80 formed with a diagonal cam channel 82 is secured to the horizontal plate 78. The diagonal cam channel 82 of the cam plate 80 is engaged to a projection 86 of a manual manipulator 84 that is mounted on the back surface of the shaver main body 10 so that it can slide horizontally. As a result, when the manual manipulator 84 is moved left and right as shown by arrows in FIG. 7, the cam plate 80 and the horizontal plate 78 are moved up and down due to the diagonal cam channel 82, and as a result the float setting members 76 are moved up and down.

When the manual manipulator 84 is moved to one side (for example to the left in FIG. 7), the float setting members 76 ascend. As a result, the slide members 62 are ascended, and the outer cutter downward pushing springs 56 extend. Accordingly, the spring force F(OUT) of the outer cutter downward pushing springs 56 becomes smaller, and the float pressure F on the outer cutters 16, which is F(TOT)=T(IN)–F(OUT), becomes larger, thus bringing a normal condition. When, conversely, the manual manipulator 84 is moved to the other side (to the right in FIG. 7), then the slide members 62 are descended, and the outer cutter downward pushing springs 56 are compressed and contract. Accordingly, the spring force F(OUT) on the outer cutter downward pushing springs 56 become larger, and the float pressure F(TOT) on the outer cutters 16 becomes smaller, so that a soft condition is brought, and the outer cutters 16 are moved up and down smoothly, nicely following the curved surfaces of the skin.

In the above-described embodiment, the outer cutter downward pushing springs 56 are the outer cutter elastically supporting members. However, in the present invention, the outer cutter elastically supporting members can be elastic bodies made of a synthetic resin and not a spring.

The invention claimed is:

1. A reciprocating electric shaver comprising:

an outer cutter which is substantially inverted-U-shaped when viewed from a side thereof and is provided so as to slide up and down in an outer cutter frame that is detachably mounted on a main body of the shaver, and an inner cutter which is reciprocated while being pressed against an inner surface of the outer cutter;

wherein said shaver further comprises:

an inner cutter upwardly pushing spring for pressing said inner cutter against the inner surface of said outer cutter;

a slide member slidably provided on said outer cutter frame;

an outer cutter elastically supporting member for elastically supporting said outer cutter, said outer cutter elastically supporting member being mounted on said outer cutter frame with one end thereof being engaged with said slide member and another end thereof being engaged with said outer cutter; and a float setting member provided in said main body of the shaver said float setting member being caused to engage said slide member, in linkage with a mounting motion of said outer cutter frame relative to said shaver main body, thus determining a position of said slide member; and wherein said outer cutter elastically supporting member urges said outer cutter downward and a spring force thereof is set smaller than a spring force of said inner cutter upwardly pushing spring.

2. The reciprocating electric shaver according to claim 1, wherein said outer cutter elastically supporting member is a compression coil spring that is compressed and installed between said outer cutter and said outer cutter frame and pushes the outer cutter downward.

3. The reciprocating electric shaver according to claim 1, wherein said outer cutter elastically supporting member is a pulling spring that pulls said outer cutter downward.

4. The reciprocating electric shaver according to any one of claims 1, 2 and 3, wherein a plurality of said outer cutter elastically supporting members are provided so as to elastically support both ends of said outer cutter.

5. The reciprocating electric shaver according to claim 1, wherein said slide member is capable of moving up and down relative to said outer cutter frame, and said outer cutter elastically supporting member is a compression coil spring that urges said outer cutter downward, with an upper end thereof being in contact with said slide member and a lower end thereof being in contact with said outer cutter.

6. The reciprocating electric shaver according to claim 5, wherein said slide members is provided with a downward return force imparted by a slide member downward pushing spring having a restorative force greater than a spring force of said compression coil which is said outer cutter elastically supporting member and is compressed and installed between said outer cutter and said outer cutter frame.

7. The reciprocating electric shaver according to claim 5 or 6, wherein said float setting member engages said slide members from below, and a height of said float setting member is changeable by a manual manipulator provided in said shaver main body.

* * * * *